United States Patent [19]

Hamilton

[11] Patent Number: 4,903,579

[45] Date of Patent: Feb. 27, 1990

[54] PRESSURE-RELEASE VALVE AND CONDUIT FOR PREVENTING DAMAGE TO SEAL OF HYDRAULIC POWER DRIVE UNIT

[76] Inventor: Harry J. Hamilton, 12 Waltersland Road, Stillorgan, County Dublin, Ireland

[21] Appl. No.: 235,959

[22] Filed: Aug. 24, 1988

[51] Int. Cl.[4] ..... F01M 1/10; F01M 1/16; F01M 1/20

[52] U.S. Cl. ..... 92/86; 92/153; 184/107; 60/456; 137/68.1; 137/797; 277/15; 277/70; 277/DIG. 10

[58] Field of Search ..... 417/366, 369; 184/107; 277/15–18, DIG. 10, 70; 92/82, 86, 153, 156; 137/68.1, 797; 91/46, 451, 471; 60/456, 468

[56] References Cited

U.S. PATENT DOCUMENTS

| | | | |
|---|---|---|---|
| 2,430,394 | 11/1947 | Folke et al. | 92/156 X |
| 3,116,747 | 1/1964 | Cowles et al. | 137/68.1 |
| 3,453,995 | 7/1969 | Pelizzoni et al. | 92/156 X |
| 3,742,822 | 7/1973 | Talbert | 92/86 |
| 4,550,805 | 11/1985 | Zimmerman | 92/156 X |
| 4,669,999 | 6/1987 | Miller | 137/68.1 X |

FOREIGN PATENT DOCUMENTS

| | | | |
|---|---|---|---|
| 528418 | 6/1977 | U.S.S.R. | 137/68.1 |

*Primary Examiner*—Robert E. Garrett
*Assistant Examiner*—George Kapsalas
*Attorney, Agent, or Firm*—Ostrolenk, Faber, Gerb & Soffen

[57] ABSTRACT

A hydraulic power drive unit for connection to the hydraulic system of an agricultural tractor is provided with a pressure release valve to protect the unit seal from damage if connected the wrong way round, and a bleed pipe which bursts to relieve pressure if the pressure release valve fails to operate.

4 Claims, 2 Drawing Sheets

PRESSURE-RELEASE VALVE AND CONDUIT FOR PREVENTING DAMAGE TO SEAL OF HYDRAULIC POWER DRIVE UNIT

BACKGROUND OF THE INVENTION

1. Field of the Invention

The present invention relates to hydraulically driven tools or instruments, such as for example chain saws, and in particular to a drive unit for such tools or instruments.

2. Description of the Prior Art

Hydraulically driven chain saws have been used for some years. Connections are provided on the chain saw for attachment to the feed and return hoses or pipes of a hydraulic power source.

The hydraulic power source which is most often used is a so-called hydraulic power-pack, that is a free-standing hydraulic power system which may be transported on a vehicle to the desired location of use, and then used to drive a variety of different tools or instruments.

Another hydraulic power source which has been used is the hydraulic system of a prime mover, such as for example a conventional agricultural tractor.

The use of the hydraulic system of a conventional agricultural tractor as a source of hydraulic pressure presents certain difficulties when operating particular types pf tools such as chain saws. The principal difficulty relates to the fact that the two hydraulic connections from the agricultural tractor for feed and return of hydraulic fluid, unlike those of the hydraulic power-pack, are identical, and that the tractor hydraulic system may be driven in either direction. Hydraulic chain saws and other such hydraulic devices are usually designed to have hydraulic fluid flowing in one direction only. As a result, from time to time the hydraulic chain saw may be connected the wrong way around to the hydraulic system of the agricultural tractor and may be damaged.

The circumstances in which such damage most often arises will now be described more particularly. The chain saw comprises a hydraulic motor driven by hydraulic fluid pressure. The drive from the chain saw motor, which is contained in a sealed housing, is transmitted by means of a drive shaft to the chain saw sprocket which is located outside the housing. The drive shaft passes through a seal on the wall of the housing. The hydraulic fluid, as well as serving its principal purpose of driving the chain saw motor, also lubricates the chain saw motor and the drive shaft and lubricates the region of the seal. A bleed pipe leads from the region of the seal to the return side of the motor so that lubricating hydraulic fluid may be re-circulated. The seal is subject to the lower hydraulic pressure which prevails at the fluid return side of the motor and is specified to withstand that lower pressure. If the chain saw is inadvertently connected the wrong way around to the hydraulic system of the tractor the seal is directly subjected to the higher feed pressure and the seal or the housing itself may become damaged. Alternatively, if the chain saw feed pipe is connected correctly but the chain saw return pipe is inadvertently not connected, or alternatively becomes blocked, then a back pressure may build up at the return side of the bleed pipe and the feed pressure is applied indirectly to the seal.

An object of the present invention is to provide a hydraulic drive unit which may be attached to the hydraulic system of a conventional agricultural tractor or other prime mover without the risk of damage. such a drive unit could be used to drive a variety of different tools, a chain saw being just one example. Such a drive unit would allow hydraulic tools to be used much more widely and to be generally more versatile, as agricultural tractors are more numerous than hydraulic power-packs and are more mobile.

SUMMARY OF THE INVENTION

The invention provides, in a hydraulic power drive unit comprising a housing, a hydraulic fluid feed pipe leading to the housing, a hydraulic fluid return pipe leading from the housing, a hydraulic motor contained in the housing, a drive shaft one end of which is connected to the hydraulic motor and the other end of which projects from the housing, a hydraulic fluid seal between the drive shaft and the housing to prevent loss of hydraulic fluid from the housing, the hydraulic fluid seal being lubricated by the hydraulic fluid at the lower or return pressure which prevails in the housing, and a bleed pipe for conducting the lubricating hydraulic fluid from the region of the seal to the hydraulic fluid return pipe; the improvement wherein the bleed pipe comprises pressure release means for releasing pressure at a pressure level less than the pressure threshold of the hydraulic fluid seal.

The pressure release means may comprise a pressure release valve.

Alternatively, the pressure release means may comprise bleed pipe walls designed to fail at a pressure level less than the pressure threshold of the hydraulic fluid seal.

The pressure release means may comprise the aforementioned two features in combination, with the bleed pipe walls being designed to fail at a pressure greater than the pressure at which the pressure release valve operates, whereby in the event of a malfunction of the pressure release valve, the bleed pipe would fail and thus protect the hydraulic fluid seal.

BRIEF DESCRIPTION OF THE DRAWINGS

The invention will now be described more particularly with reference to the accompanying drawings which show, by way of example only, a hydraulic power drive unit according to the invention. In the drawings.

DESCRIPTION OF THE INVENTION

Figure 1:
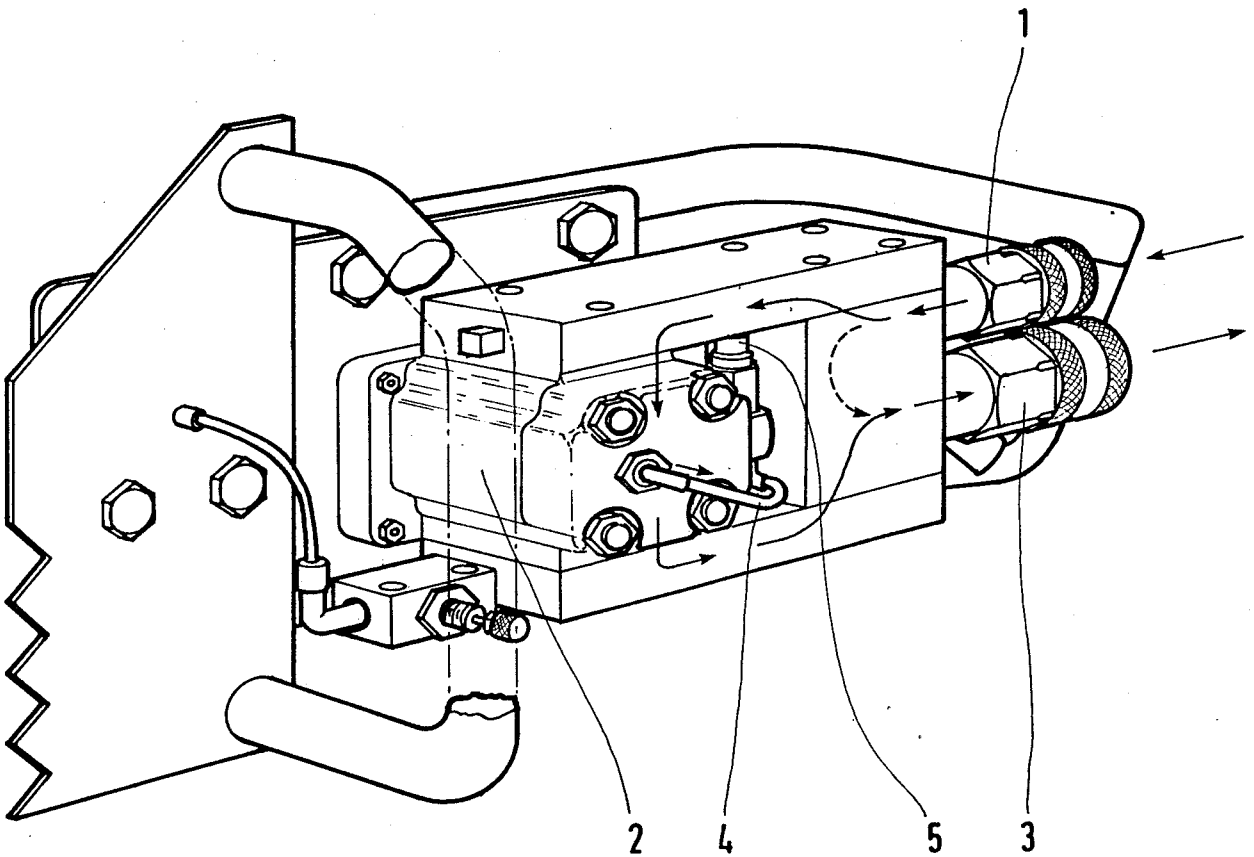
FIG. 1 is a perspective view of the hydraulic power drive unit.
Figure 2:
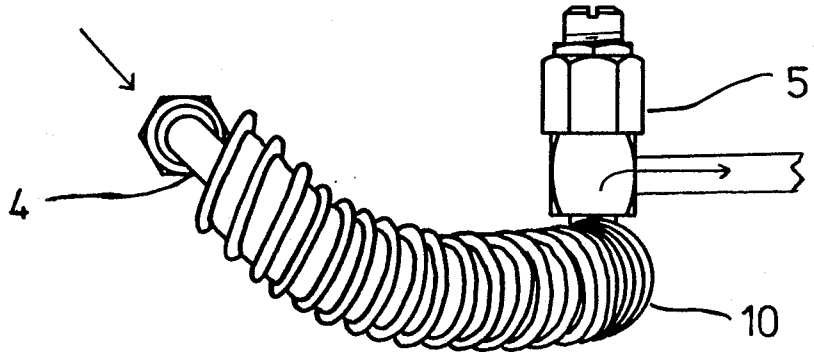
FIG. 2 is a side view of the pressure release valve and bleed pipe.

Referring to the drawings the drive unit comprises a feed pipe 1, a hydraulic motor 2 and a return pipe 3. (The connecting pipes from the hydraulic power source are not shown).

In normal use the feed pipe 1 is subject to a higher feed pressure and the return pipe 3 to a lower return pressure. A hydraulic fluid seal or seals (not shown) in the motor 2 is lubricated by the hydraulic fluid and is also subject to the lower pressure and is specified and tested to the lower pressure only. Fluid from the region of the seal flows through bleed pipe 4 to the return pipe 3. The direction of fluid flow when the trigger (not shown) is operated is indicated by arrows. The dotted line indicates the flow when the trigger is not operated.

The higher pressure, however, may be inadvertently applied to the return pipe 3 and thus to the bleed pipe 4 and thereby to the seal. This inadvertent application of the higher pressure may arise in either of the two manners previously described. Should this happen, when the higher pressure is so applied, pressure release valve 5 operates to release the excess pressure. If for any reason the pressure release valve 5 does not operate when it should, the bleed pipe 4, which is made of plastics material, is specified to fail at a pressure threshold which is slightly higher than that specified for the bleed valve 5 but is nevertheless lower than that specified for the seal. The seal is thus protected from damage. The bleed pipe 4 is provided with a cylindrical plastics or rubber sleeve 10 so that if the bleed pipe 4 fails, the operator of the hydraulic power drive unit is protected from the release of hydraulic fluid.

The pressure release valve 5 includes a spring loaded plunger (shown) which is movable by a predetermined pressure and automatically returns to its normal position after the pressure has released.

I claim:

1. In a hydraulic power drive unit for connection and disconnection to a source of hydraulic power by a user, the unit comprising a housing, a hydraulic fluid feed pipe leading to the housing, a hydraulic fluid return pipe leading from the housing, a hydraulic motor contained in the housing, a drive shaft one end of which is connected to the hydraulic motor and the other end of which projects from the housing, a hydraulic fluid seal between the drive shaft and the housing to prevent loss of hydraulic fluid from the housing, the hydraulic fluid seal being lubricated by the hydraulic fluid at the lower pressure which prevails in the housing, and a bleed pipe for conducting the lubricating hydraulic fluid from the housing to the hydraulic fluid return pipe downstream of the hydraulic motor; the improvement wherein the bleed pipe comprises pressure release means for releasing pressure at a pressure level less than the pressure threshold of the hydraulic fluid seal, whereby hydraulic fluid at higher pressure which inadvertently enters the bleed pipe from the downstream side thereof is released externally from the hydraulic power drive unit to prevent the higher pressure from reaching the hydraulic fluid seal.

2. A hydraulic power drive unit in accordance with claim 1, wherein the pressure release means comprises a pressure release valve.

3. In a hydraulic power drive unit comprising a housing, a hydraulic fluid feed pipe leading to the housing, a hydraulic fluid return pipe leading from the housing, a hydraulic motor contained in the housing, a drive shaft one end of which is connected to the hydraulic motor and the other end of which projects from the housing, a hydraulic fluid seal between the drive shaft and the housing to prevent loss of hydraulic fluid from the housing, the hydraulic fluid seal being lubricated by the hydraulic fluid at the lower or return pressure which prevails in the housing, and a bleed pipe for conducting the lubricating hydraulic fluid from the region of the seal to the hydraulic fluid return pipe; the improvement wherein:

the bleed pipe comprises pressure release means for releasing pressure at a pressure level less than the pressure threshold of the hydraulic fluid seal; and the pressure release means comprises comprises bleed pipe walls designed to fail at a pressure level less than the pressure threshold of the hydraulic fluid seal.

4. In a hydraulic power drive unit comprising a housing, a hydraulic fluid feed pipe leading to the housing, a hydraulic fluid return pipe leading from the housing, a hydraulic motor contained in the housing, a drive shaft one end of which is connected to the hydraulic motor and the other end of which projects from the housing, a hydraulic fluid seal between the drive shaft and the housing to prevent loss of hydraulic fluid from the housing, the hydraulic fluid seal being lubricated by the hydraulic fluid at the lower or return pressure which prevails in the housing, and a bleed pipe for conducting the lubricating hydraulic fluid from the region of the seal to the hydraulic fluid return pipe; the improvement wherein:

the bleed pipe comprises pressure release means for releasing pressure at a pressure level less than the pressure threshold of the hydraulic fluid seal;

the pressure release means comprises a pressure release valve;

the pressure release means comprises bleed pipe walls designed to fail at a pressure level less than the pressure threshold of the hydraulic fluid seal; and the bleed pipe walls are designed to fail at a pressure level greater than the pressure level at which the pressure release valve operates, whereby in the event of a malfunction of the pressure release valve, the bleed pipe would fail and thus protect the hydraulic fluid seal.

* * * * *